United States Patent [19]

Berfield

[11] Patent Number: 4,501,378

[45] Date of Patent: Feb. 26, 1985

[54] RESILIENT DETENTED LID LATCH

[75] Inventor: Robert C. Berfield, Jersey Shore, Pa.

[73] Assignee: Shop-Vac Corporation, Williamsport, Pa.

[21] Appl. No.: 551,094

[22] Filed: Nov. 14, 1983

Related U.S. Application Data

[63] Continuation-in-part of Ser. No. 449,777, Dec. 14, 1982, abandoned.

[51] Int. Cl.[3] ..... B65D 45/16

[52] U.S. Cl. ..... 220/324; 220/326; 220/339; 292/87; 292/103; 292/DIG. 38

[58] Field of Search ..... 220/326, 339, 324; 292/87, 103, DIG. 38, 107, 116

[56] References Cited

U.S. PATENT DOCUMENTS

| | | | |
|---|---|---|---|
| 2,717,093 | 9/1955 | Mautner | 220/326 |
| 2,786,596 | 3/1957 | Claud-Mantle | 220/326 |
| 3,425,587 | 2/1969 | Duross, Jr. | 220/326 |
| 4,189,061 | 2/1980 | Yu | 220/326 |
| 4,190,155 | 2/1980 | Higley | 220/339 |
| 4,270,668 | 6/1981 | Berfield | 220/324 |
| 4,314,651 | 2/1982 | Gaiser et al. | 220/326 |

*Primary Examiner*—Joseph Man-Fu Moy

*Attorney, Agent, or Firm*—Ostrolenk, Faber, Gerb & Soffen

[57] ABSTRACT

A latch unit for releasably securing a plastic lid to a tank-like container or for releasably securing another covering over the container. The container may be the tank of an electric vacuum cleaner. There are a plurality of the latch units spaced along the edge of the lid or covering and engageable with a bead around the open end of the tank. Each latch unit includes a cage at the edge of the lid or of the covering and includes a latch element molded of resilient plastic material. One end of the latch element protrudes from the cage and is hand engageable for moving the element between releasing and holding positions. The other end of the element is provided with a hook that engages a cage formation to form a pivot for the element. A normally bowed intermediate section of the element connects opposite ends of the element, and is stressed to provide a biasing force that holds the element mounted to the cage. This biasing force also provides detent forces required to maintain the latch element in the holding or releasing position to which it is operated. A detent at the intermediate section of the element engages an upstanding wall of the cage to hold the element in the releasing position.

25 Claims, 13 Drawing Figures

RESILIENT DETENTED LID LATCH

CROSS REFERENCE TO RELATED APPLICATION

This is a continuation-in-part of Ser. No. 449,777, filed Dec. 14, 1982, now abandoned.

BACKGROUND OF THE INVENTION

This invention relates to latches in general, and more particularly relates to a latch for releasably securing a covering to a container.

My U.S. Pat. No. 4,270,668, issued June 2, 1981 and entitled "Buckle or Latch for Holding Lid to Container" discloses latch means for releasably securing a lid over the top opening in a tank or container which is used to collect solid or liquid materials picked up by a vacuum cleaner. In many vacuum cleaners of this type, the tank is constructed of sheet metal and the cover is molded of plastic. The latch means disclosed in my aforesaid U.S. Pat. No. 4,270,668 includes a plurality of latch elements each pivotally mounted on the side wall of the tank by a separate molded plastic retaining member. With such construction the retaining members must be riveted or otherwise secured to the tank by a plurality of retaining formations. The latch members, when open, hang loosely and are disposed so that they are vulnerable to being subjected to excessive mechanical forces, particularly at the pivotal connection between the retainer and the latch member.

SUMMARY OF THE INVENTION

In accordance with the instant invention, latch means are constructed by providing at least one or, more typically, a plurality of cages that are formed or molded integrally with or are affixed to the lid or the covering over the tank and are spaced along the periphery thereof. Each cage is provided with a respective, resilient molded plastic latch member having a bottom end that is snapped into place in the cage. The latch member extends up toward the lid or covering, and only a limited portion of the latch member is exposed. The pivot connection between the latch member and the cage is essentially concealed. This construction eliminates the necessity for individual securement of latch element retaining members. The resilient latch member is deflected and also pivots around the pivot connection between an opened position at which it is separated from the lid or covering and a closed position at which it latches the lid to the top of the tank. The top portion of the latch element away from the pivot connection includes an upper section which latches the lid or covering. The cage has a detenting element which projects up from the pivot connection for engaging the latch element to retain it in the opened position. There is a detent in the latch member for engaging the detenting element when the latch member is in the opened position to hold the latch member opened. The latch member is manually deflected and pivoted between its closed position and its opened detented position.

Accordingly, the primary object of the instant invention is to provide a novel construction for a lid or covering latch means that is relatively inexpensive to manufacture and install.

Still another object is to provide latch means of this type that includes detents to positively hold the latch element in the closed, latched or opened, unlatched position to which it has last been operated.

A further object is to provide latch means of this type in which the cage for pivotally supporting the latch elements is conveniently secured to the lid or covering being latched to the tank.

A still further object is to provide latch means of this type in which the pivot connection of the latch element is not subjected to forces tending to separate the lid or cover and the container latched thereto.

Another object is to provide latch means of this type in which the latch element may be snapped into operative position at a pivot connection which is essentially hidden from view.

These objects as well as other objects of this invention shall become readily apparent after reading the following description of the accompanying drawings.

DESCRIPTION OF THE PREFERRED EMBODIMENTS

Figure 4:
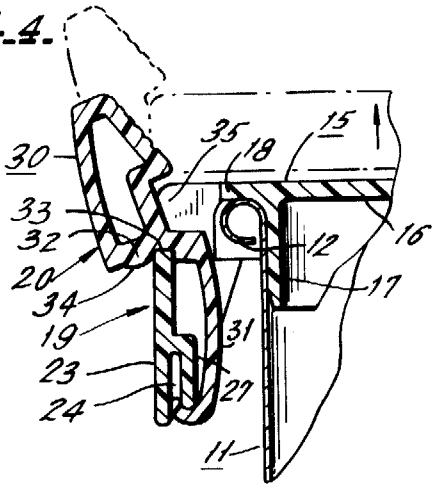
FIG. 4 is a cross-section taken through line 4—4 of FIG. 1 looking in the direction of arrows 4—4, with the latch element in its opened position.
Figure 3:
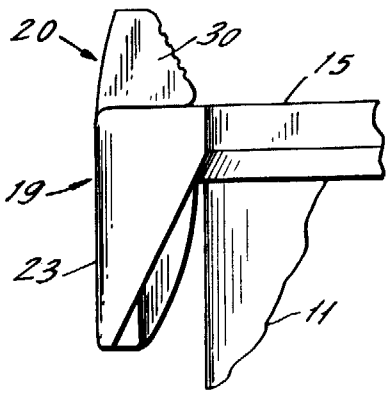
FIG. 3 is a side elevation of the elements of FIG. 2 looking in the direction of arrows 3—3.
Figure 1:
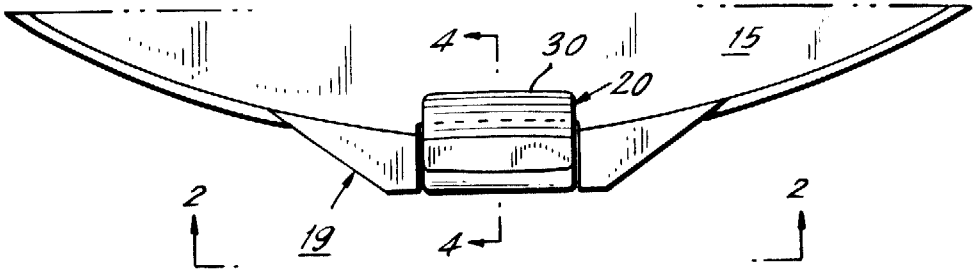
FIG. 1 is a fragmentary plan view of a cover or lid having latch means constructed in accordance with one embodiment of the invention.
Figure 2:
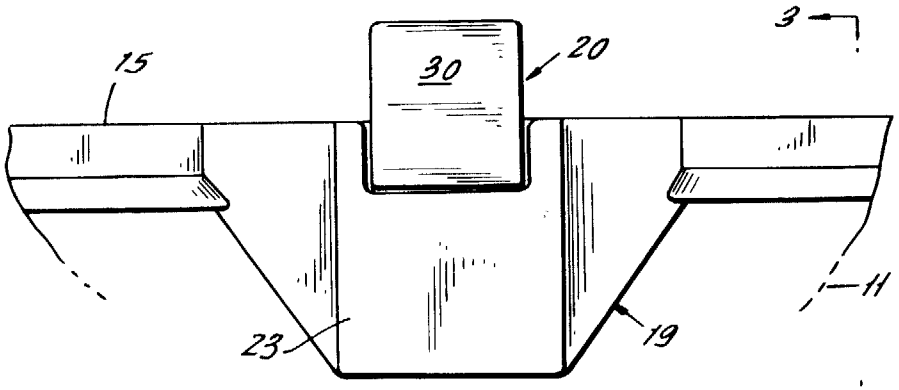
FIG. 2 is a front elevation of the elements of FIG. 1 mounted to a tank and looking in the direction of arrows 2—2 of FIG. 1.

The invention is described with reference to a cannister or tank type electric vacuum cleaner and particularly with respect to latching a lid or covering over the tank. But the latch is not limited to such an application and may be used for clamping any lid or covering over an open container.

An electric vacuum cleaner includes a generally cylindrical tank 11 with a lowr end (not shown) closed and an upper end opened. Surrounding the upper end of tank or housing 11 is outwardly extending bead or flange 12 which supports a removable flat lid or cover 15 having main central section 16. Short annular skirt 17 extends downward from main section 16 into tank 11 and lies adjacent the inner surface thereof. Short radial width annular flange 18 is generally coplanar with main section 16 and extends radially outward from skirt 17.

The lid 15 supports a blower motor which communicates into the tank 11 through the lid for causing air and materials to be drawn into the tank. As this is conventional, it is not illustrated.

A plurality of cages 19 are molded integrally with the lid 15 and are spaced at intervals around flange 18. Each cage 19 is provided with an individual molded plastic latch element 20 and together each cage and its latch element constitute a latch unit for removably securing lid 15 to tank 11. In some cases, only one latch unit is needed, as, for instance, with a cover that is hinged at another location to the tank. In other cases, as when the lid is completely removable, plural latch units are needed.

Figure 6:
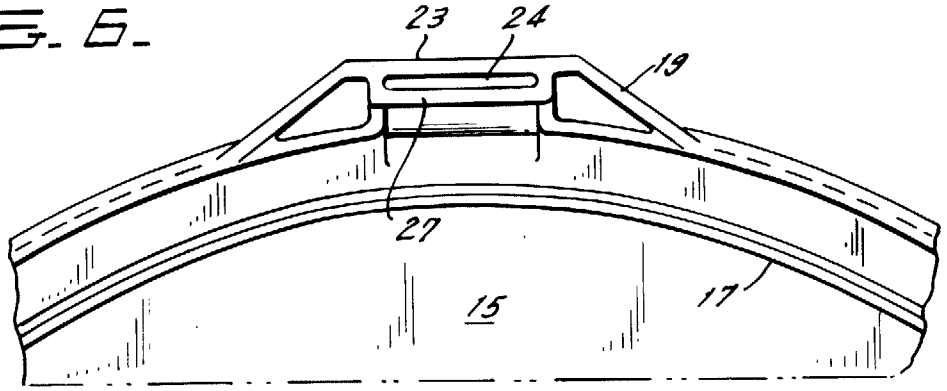
FIG. 6 is a bottom view of the lid and the cage of the latch looking in the direction of arrows 6—6 of FIG. 5.
Figure 5:
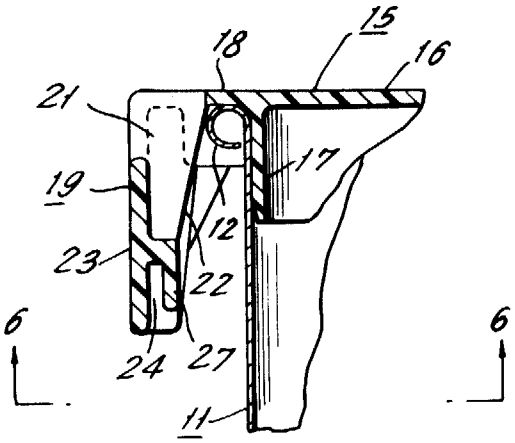
FIG. 5 is a view similar to FIG. 4 with the latch element removed.

As seen in FIGS. 5 and 6, the central portion of cage 19 is spaced radially out from skirt 17 and is also spaced out from the outer wall of tank 11. Latch element 20 is inserted through opening 21 at the outside and top of cage 19 and through opening 22 in the interior surface of cage 19 that confronts the side of tank 11. Cage 19 includes outer wall 23 and lower inner wall 27 which define recess 24 between them to receive for pivoting the hooked lower end 26 of latch element 20. Cage wall 27 is generally parallel to wall 23 and the lower edge of wall 27 defines a horizontal pivot for latch element 20 so that upper manually engageable section 30 of element 20 is movable between its outer, open, lid releasing position (FIG. 4) and its inner closed lid clamping position (FIG. 7).

Latch element 20 is of a resilient material, e.g. plastic, which permits it to be pivoted and deflected between and latched at its opened and closed positions and enables it to resiliently clamp the lid. Latch element 20 includes normally bowed intermediate section 31 that extends from its upper section 30 to its lower section 26. With latch element 20 operatively mounted to cage 19 with the hook 26 around the bottom of the wall 27 in the groove 24, and the upper section 30 in the recess 24, intermediate section 31 is curved outwardly and is resiliently stressed to create a biasing force urging hook 26 upward against the lower edge of wall 27 and urging lower wall 32 of upper section 30 downward against the upper edge 33 of cage wall 23. Wall 32 is provided with downwardly slightly extending detent projection 34 which cooperates in detenting the latch element in both of its opened and closed positions. The inwardly facing wall of the intermediate section 31 is indented to provide an inwardly facing pocket 35. The pocket 35 receives lid flange 18 and container flange 12 when latch element 20 is in the holding position inboard of cage wall 23 so as to detent latch element 20 in its holding position of FIG. 7.

Figure 7:
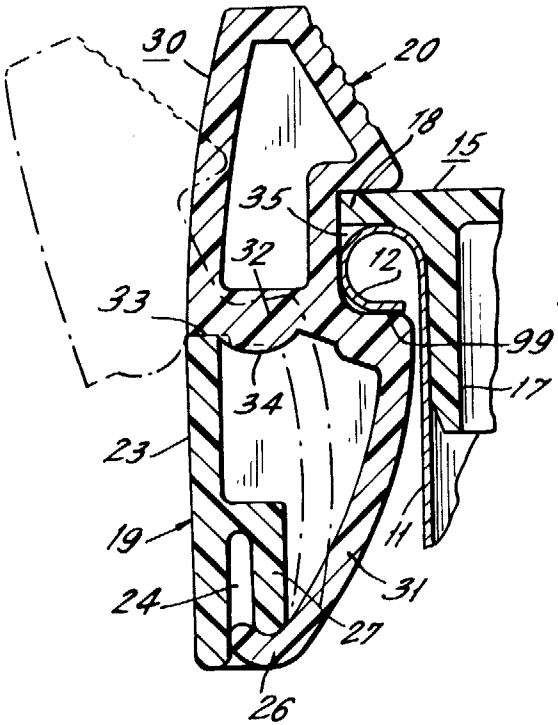
FIG. 7 is an enlargement of the elements of FIG. 4 with the latch element in the closed position.
Figure 13:
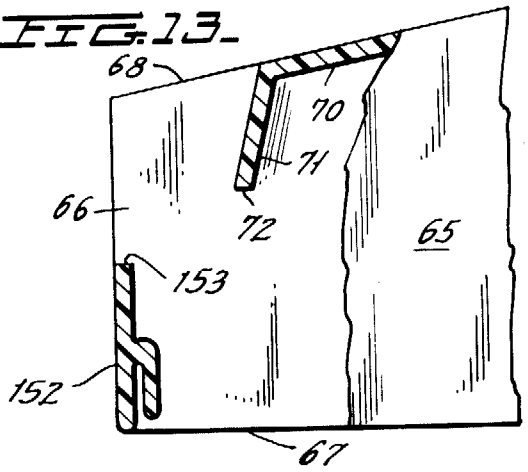
FIG. 13 is the same type of view as FIG. 12 with the latch element omitted.
Figure 12:
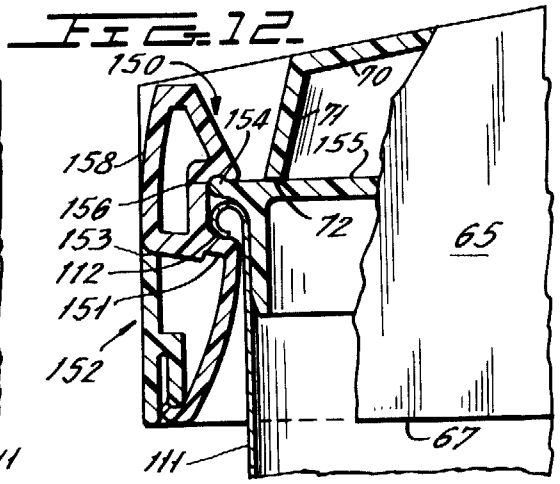
FIG. 12 is a cross-section taken through lines 12—12 of FIG. 11 looking in the direction of the arrows 12—12, with the latch element in its closed position.
Figure 10:
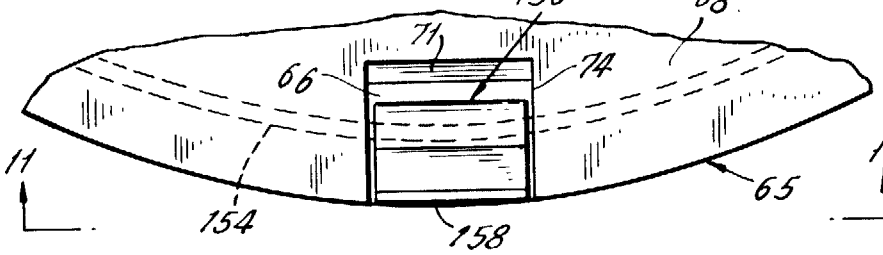
FIG. 10 is a fragmentary plan view of a covering having latch means constructed in accordance with a third embodiment of the invention.
Figure 11:
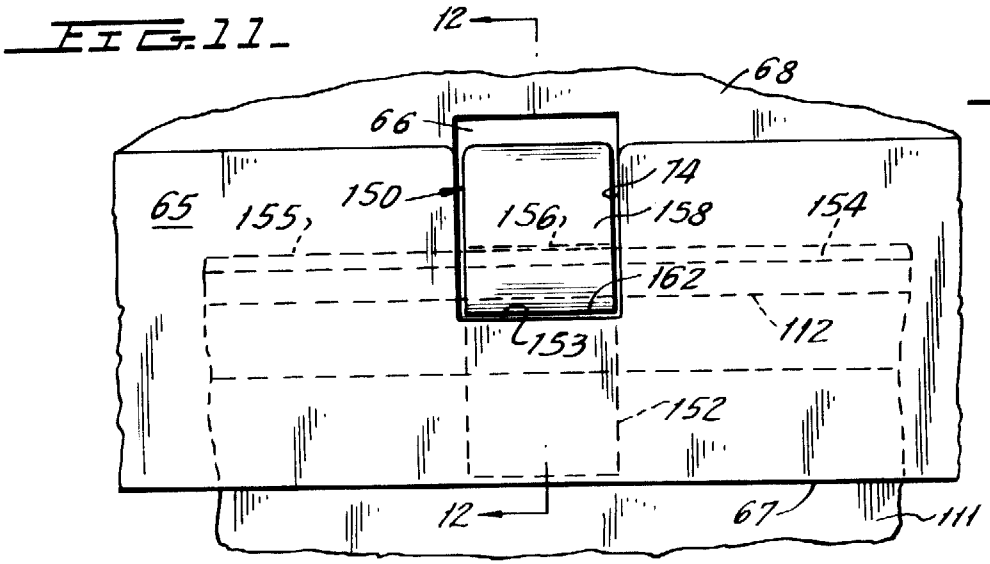
FIG. 11 is a front elevation of the elements of FIG. 10 as mounted to a tank and looking in the direction of arrows 11—11 of FIG. 10.

When latch element 20 is pivoted outwardly about the lower edge of cage wall 27, which serves as a horizontal pivot, upper section 30 moves from the holding position of FIG. 7 to the releasing position of FIG. 4. In the latter position of element 20, container flange 12 is no longer within pocket 35 and container 11 is released from being held by latch element 20. In this position of element 20, detent formation 34 has been shifted outboard of cage wall 23 and is maintained and detented in this releasing position until positively moved inward. The biasing action of resilient intermediate section 31 in its stressed condition assures that the lower surface of wall 32 remains in contact with upper edge 33 of cage wall 23 while upper section 30 of the latch element is moved between the positions of FIGS. 4 and 7.

With latch element 20 in its holding position of FIG. 7, forces tending to separate lid 15 from container 11 are essentially isolated from the pivot connection between cage wall 27 and hooked lower section 26. Instead, these forces will be confined to the area indicated by the reference numeral 99 where flange 12 is engaged by the inner surface of pocket 35.

Figure 9:
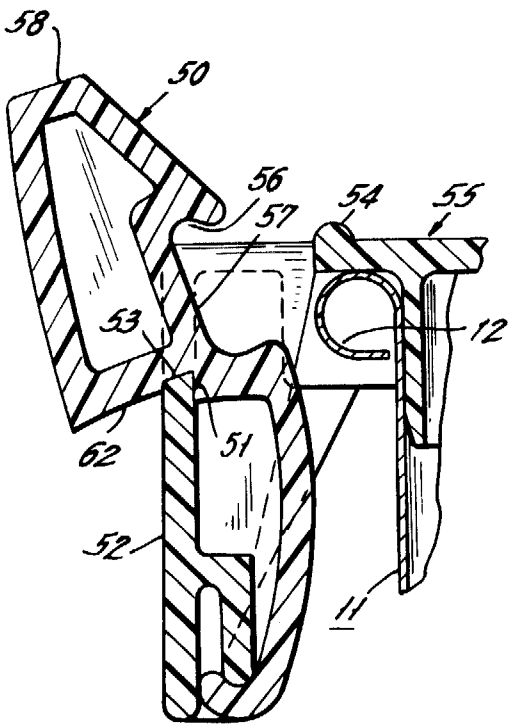
FIGS. 8 and 9 are cross-sections of another embodiment of this invention with the latch element in the closed position in FIG. 8 and in the opened position in FIG. 9.
Figure 8:
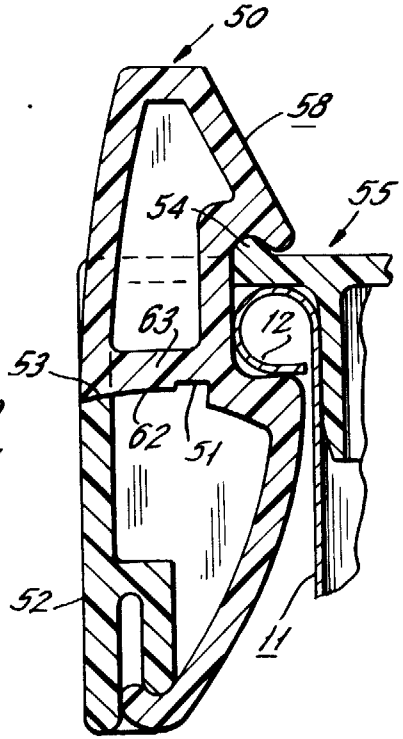

In the second embodiment of FIGS. 8 and 9, the different detent functions are achieved by different formations of the latch element. Latch element 50 of FIGS. 8 and 9 achieves the releasing position detent function through the cooperation between detent recess 51 and the upper edge 53 of cage wall 52 which is received in that recess. Recess 51 is in lower surface 62 of wall 63 at the bottom of upper section 58. Wall edge 52 and surface 62 are similarly curved to facilitate sliding movement of the surface over the edge. The holding position detent function is achieved by cooperation of protrusion 54 extending upwardly from lid 55 which is received by section 56 of pocket 57 in the upper section 58 of latch element 50. Pocket 57 receives bead-like flange 12 of container 11 when latch element 50 is in its holding position of FIG. 8.

In the third embodiment of FIGS. 10–13, elements that correspond to those shown in the second embodiment of FIGS. 8 and 9 have reference numerals corresponding to the elements described with respect to the second embodiment, raised by 100, and those elements are not further described herein. Additional elements are numbered with reference numerals below 100.

This embodiment primarily differs from the previous embodiment in that the cage 152 is not defined on the lid 155, but is instead defined on a separate covering 65 which is disposed over the top of the lid 155, and particularly would be disposed over the motor housing (not shown) for noise reduction, or the like purposes. The covering 65 is separate from the lid 155. The covering 65 includes an exterior shell 66 which is shaped to cover an object on the lid 155 and which may, for example, be circular to match the circular shape of the lid, for example. The covering 65 is open at its bottom end 67 and is closed at its top end 68. Beneath its top end 68 is the lid engaging formation 70 which may be an annular formation with a depending wall 71 of a length so that its bottom end 72 rests against the top of the lid 155, which holds the lid to the tank and in turn holds the covering at the lid. In the second embodiment, the cage 152 was integrally defined on a downwardly depending extension of the lid. In this embodiment, in contrast, the lid has no such downward extension. In its place, at spaced locations around the wall 66 of the shell, the cages 152 are defined. Above the cage 152 there is a cutout 74 of the width of the latch element top section 58 and of the height thereof down to the surface 162 thereon. The recess 74 also extends inwardly from the peripheral edge of the wall 66 of the covering to permit manual access to the upper edge of the latch element 150. The recess 74 provides clearance for the upper section 130 of the latch element 120 to move between the opened condition and the illustrated closed condition in FIG. 12.

Because the latch element 150 is supported at the cage 152 on the covering 65, rather than being supported on the lid as in the prior embodiments, the latch element 150 is installed at the lid with and removal from the lid along with the covering 65. To assure proper delivery of the latch element 150, it should be hooked in its detented opened position on the cage 152 when the covering 65 is removed or installed over the lid. After the lid 155 is installed on the tank 111, but is not clamped there, the covering 65 is applied over the top of the lid. The wall 71 presses down upon the lid 155, which supports the covering in the correct location and also holds the lid down. The latch element 150 is now pivoted inwardly and engages the bead 154 of the lid 155 and the bead 112 of the tank 111. In other respects, this embodiment will be like the second embodiment. The latch element operates the same and has the same structure. The cage 152 has the same structure and operates at the same manner.

Although the present invention has been described in connection with preferred embodiments thereof, many variations and modification will now become apparent to those skilled in the art. It is preferred, therefore, that the present invention be limited not by the specific disclosure herein, but only by the appended claims.

What is claimed is:

1. A container having an opening and flange means projecting outwardly from said opening, a lid for covering said opening, and a plurality of latch units cooperating with said flange means to operatively secure said lid to said container; said plurality of latch units mounted to said lid and spaced along the edge thereof; each of said latch units including cage means fixedly mounted on said lid, and latch means pivotally mounted to said cage means; said cage means including a wall section spaced outward of a sidewall of said container and having an upper edge; said latch means including a pivot forming lower section, a manually engageable upper section, and an intermediate section between said upper and lower sections; said upper section projecting above said upper edge and said intermediate section disposed between said wall section and said sidewall; means defining a horizontal axis at said lower section about which said upper section is movable between an inner container holding position and an outer container releasing position; said upper section defining a recess in which said flange means is entered when said upper section is in said holding position; said upper section also including a formation that cooperates with said upper edge to define detent means for releasably maintaining said upper section in said releasing position.

2. Container, lid and latch units as defined in claim 1 in which said intermediate section includes biasing means for urging said upper section downward against said upper edge.

3. Container, lid and latch units as defined in claim 2 in which said upper section includes a generally horizontal wall that rides on said upper edge as said upper section moves between said holding and releasing positions.

4. Container, lid and latch units as defined in claim 3 in which said formation of said upper section includes a projection extending downward from said horizontal wall and movable to positions inboard and outboard of said upper edge; with said projection outboard of said upper edge, said detent means maintaining said upper section in said releasing position, and with said projection inboard of said upper edge, said detent means maintaining said upper section in said holding position.

5. Container, lid and latch units as defined in claim 3 in which said formation of said upper section includes a recess in said horizontal wall positioned to receive said upper edge when said upper section is in said releasing position; said upper section including another formation that is releasably engageable with a detent formation in the upper surface of the lid for maintaining said upper section in said holding position.

6. Container, lid and latch units as defined in claim 3 in which the latch means comprises an element constructed of resilient material; said intermediate section normally being bowed; said intermediate section being stressed to constitute said biasing means.

7. Container, lid and latch units as defined in claim 6 in which said lower section includes a hook formation that abuts a downwardly facing surface of said cage means to cooperate therewith in defining said horizontal axis.

8. Container, lid and latch units as defined in claim 6 in which said cage means for all of the latch units are formed integrally with the lid.

9. Container, lid and latch units as defined in claim 8 in which the cage and lid are molded of plastic material.

10. Clamping means for clamping a covering, or the like, to the open end of a container, wherein the container has a sidewall, and an open end defined by the periphery of the sidewall, and the covering includes an annular portion which overlays the periphery of the sidewall, and the covering includes a flange projecting outwardly over the periphery of the sidewall;

the latch unit comprising cage means fixedly mounted to the covering for providing a support for latch means, and comprising latch means having a bottom end thereof which is pivotally mounted to said cage means;

said cage means including a wall section spaced outward of a sidewall of said container and having an upper edge; said latch means including a pivot forming lower section, a manually engageable upper section, and an intermediate section between said upper and lower sections; said upper section projecting above said upper edge and said intermediate section disposed between said wall section and said sidewall; means defining a horizontal axis at said lower section about which said upper section is movable between an inner container holding position and an outer container releasing position; said upper section defining a recess wherein said flange is entered when said upper section is in said holding position; said upper section also including a formation that cooperates with said upper edge to define detent means for releasably maintaining said upper section in said releasing position.

11. The latch unit of claim 10 in which said intermediate section includes biasing means for urging said upper section downward against said upper edge.

12. The latch unit of claim 10 in which the upper section includes a generally horizontal wall that rides on said upper edge as said upper section moves between said holding and releasing positions.

13. The latch unit of claim 12 in which said formation of said upper section includes a projection extending downward from said horizontal wall and movable to positions inboard and outboard of said upper edge; with said projection outboard of said upper edge, said detent means maintaining said upper section in said releasing position, and with said projection inboard of said upper edge, said detent means maintaining said upper section in said holding position.

14. The latch unit of claim 12 in which said formation of said upper section includes a recess in said horizontal wall positioned to receive said upper edge when said upper section is in said releasing position; said upper section including another formation that is releasably engageable with a detent formation in the upper surface of the covering for maintaining said upper section in said holding position.

15. The latch unit of claim 12 in which the latch means comprises an element constructed of resilient material; said intermediate section being stressed to constitute said biasing means.

16. The latch unit of claim 15, wherein said intermediate section is normally bowed in a direction which normally biases said upper section toward the covering.

17. The latch unit of claim 15 in which the lower section includes a hook formation that abuts a downwardly facing surface of said cage means to cooperate therewith in defining said horizontal axis.

18. The latch unit of claim 15 in which the lower section is disposed between the wall section and the sidewall of said container.

19. The latch unit of claim 16 in which the latch element is molded of plastic material.

20. The latch unit of claim 15 in which said cage means for said latch unit are formed integrally with said covering.

21. The latch unit of claim 20 in which said cage means and said covering are molded of plastic material.

22. The latch unit of claim 15 in which said formation of said upper section includes a projection extending downward from said horizontal wall and movable to positions inboard and outboard of said upper edge; with said projection outboard of said upper edge, said detent means maintaining said upper section in said releasing position, and with said projection inboard of said upper edge, said detent means maintaining said upper section in said holding position.

23. The latch unit of claim 15 in which said formation of said upper section includes a recess in said horizontal wall positioned to receive said upper edge when said upper section is in said releasing position; said upper section including another formation that is releasably engageable with a detent formation in the upper surface of the lid for maintaining said upper section in said holding position.

24. In combination, the latch unit of claim 10, a lid serving as the covering of the container and a separate second covering for being disposed above the lid; the cage means being defined in the second covering and the second covering being shaped to enable the cage means to extend to a location along the container below the lid; the upper section recess being disposed in the latch means at a location such that with the covering over the lid and latch means in engagement with the cage means, the upper section is movable for cooperating with the flange of the lid and the periphery of the container for holding same together.

25. The combination of claim 24, wherein the second covering includes a formation at its underside which is applied to the top of the lid when the second covering is over the lid, for resting on the lid and for thereby relating the positions of the second covering and lid.

* * * * *